US005669527A

United States Patent [19]

Hardy

[11] Patent Number: 5,669,527

[45] Date of Patent: Sep. 23, 1997

[54] GRAVITY FEED DISPENSER

[75] Inventor: Stephen N. Hardy, Wadsworth, Ohio

[73] Assignee: RTC Industries, Inc., Chicago, Ill.

[21] Appl. No.: 618,244

[22] Filed: Mar. 18, 1996

[51] Int. Cl.[6] ..... B65H 3/00

[52] U.S. Cl. ..... 221/191; 211/74

[58] Field of Search ..... 211/59.2, 74, 81; 221/193, 191, 307, 303, 92; 312/42, 45, 72

[56] References Cited

U.S. PATENT DOCUMENTS 5,586,687 12/1996 Spamer et al. ..... 211/59.2

*Primary Examiner*—Kenneth Noland

*Attorney, Agent, or Firm*—Dressler, Rockey, Milnamow & Katz, Ltd.

[57] ABSTRACT

A gravity feed system for a merchandise dispenser such as a refrigerated cooler. This includes a plurality of downwardly inclined track assemblies that support a row of bottles by its neck flanges. The forwardmost bottle is prevented from exiting its track by a stop member. The stop member includes an opening whereby when the bottle is tilted toward the horizontal it can be removed from its track. The stop member also includes an arrangement for preventing tilting of the bottle when in its forwardmost position.

15 Claims, 2 Drawing Sheets

GRAVITY FEED DISPENSER

FIELD OF THE INVENTION

This invention relates to merchandise dispensing systems, particularly to those used for supporting rows of bottles in a refrigerated cooler. In a typical cooler, bottles are arranged in rows, where upon opening the door of the cooler, a bottle from the front of the row can be removed and the remaining bottles in the row will move forward under the force of gravity to place another bottle in position adjacent the cooler door to be removed. While a refrigerated cooler has been referred to, the novel track assembly can be used with various bottle display systems.

BACKGROUND OF THE INVENTION

With the advent of convenience food stores, it is common practice to provide a refrigerated cooler which contains a plurality of bottled soft drinks that are sold individually. Initially, the typical cooler had stationary, vertically spaced shelves with the bottles merely supported thereon. When people wished to purchase a cool beverage, they would open the cooler door and remove a bottle. It can be seen that after the cooler is filled, the bottles will initially be removed from the front and then from further back until the cooler is again refilled. After a number of bottles have been taken from the cooler, it becomes slightly inconvenient and awkward to withdraw a bottle from a partially empty shelf, often requiring the purchaser to stoop down when he has to take a bottle from the rear of the cooler. It was believed that there should be a more convenient way of continuously providing the bottles in a location adjacent the front of the cooler. To this end, various mechanisms have been used to locate the rows of bottles on tracks and incline the tracks in a downward position so that the bottles would always move toward the front and therefore they would be immediately accessible upon opening the cooler door. This became more doable with the advent of bottles that had neck rings whereby the bottles could more easily be movably supportable while on a track with the bottles in a generally vertical position. The downwardly inclined track systems combined with the neck ring bottle supports resulted in gravity feed dispensing, but while these devices were generally acceptable, they were subject to possible bottle misalignment and lacked precision location of the bottles at the front end of the cooler. In addition, such track assemblies often resulted in the bottles being in a tilted position, which reduced the amount of space available for bottles in the cooler. Furthermore, such available devices did not readily lend themselves to the reloading of bottles in the cooler.

An application containing several additional but distinct embodiments entitled "Gravity Feed Track System" and assigned to the assignee of the present invention has been filed concurrently with the instant application.

SUMMARY OF THE INVENTION

In accordance with the present invention, there is provided a cooler including a plurality of transversely spaced, longitudinally extending novel track assemblies. These track assemblies provide a simple and efficient mechanism for handling downwardly inclined transversely spaced rows of bottles that are supported by rails contacted by the bottle neck flange located adjacent the closure. The assembly includes a track mechanism on which the neck flanges slide and the tracks are downwardly inclined so that each row of bottles is always located in its foremost position due to the force of gravity. Each track consists of a pair of spaced rails on which the bottle flange slides. The front end of the track assembly includes a flat plate that stops the bottles from exiting the track, but the plate is provided with an opening that is designed to permit the bottle to be removed from the track when the bottle is moved into a generally horizontal position. The design of the opening in the stop plate permits the top of the closure to partially extend therethrough whereby the closure and associated bottles will be prevented from tipping away from the track.

As aforementioned, upon tilting the bottle upward, the closure is moved into a portion of the opening that is larger than said closure, thus permitting the bottle to be removed from the track through the opening.

In a second embodiment of the novel track design, there is provided a generally rectangular tube that has an open bottom defined by transversely spaced longitudinally extending rails that define a downwardly inclined track that supports the bottle flanges of the row of bottles disposed thereon. The front end of the rectangular tube includes a downwardly extending flange that is positioned to engage the closure of the foremost bottle in a row to retain the row of bottles on the track. Below the flange, there is located an opening through which the closure can be extracted when the bottle is tipped upwardly. In this embodiment, the bottle is retained in position by a spring that acts to prevent the bottle from tilting.

It is to be noted that in both embodiments bottles can be readily reloaded in the tracks by reinserting them through the front track opening by inserting the closure end of the bottle when in a generally horizontal position and then tilting the bottle downwardly and disposing the bottle neck flange on the track rails.

DESCRIPTION OF A PREFERRED EMBODIMENT

Figure 1:
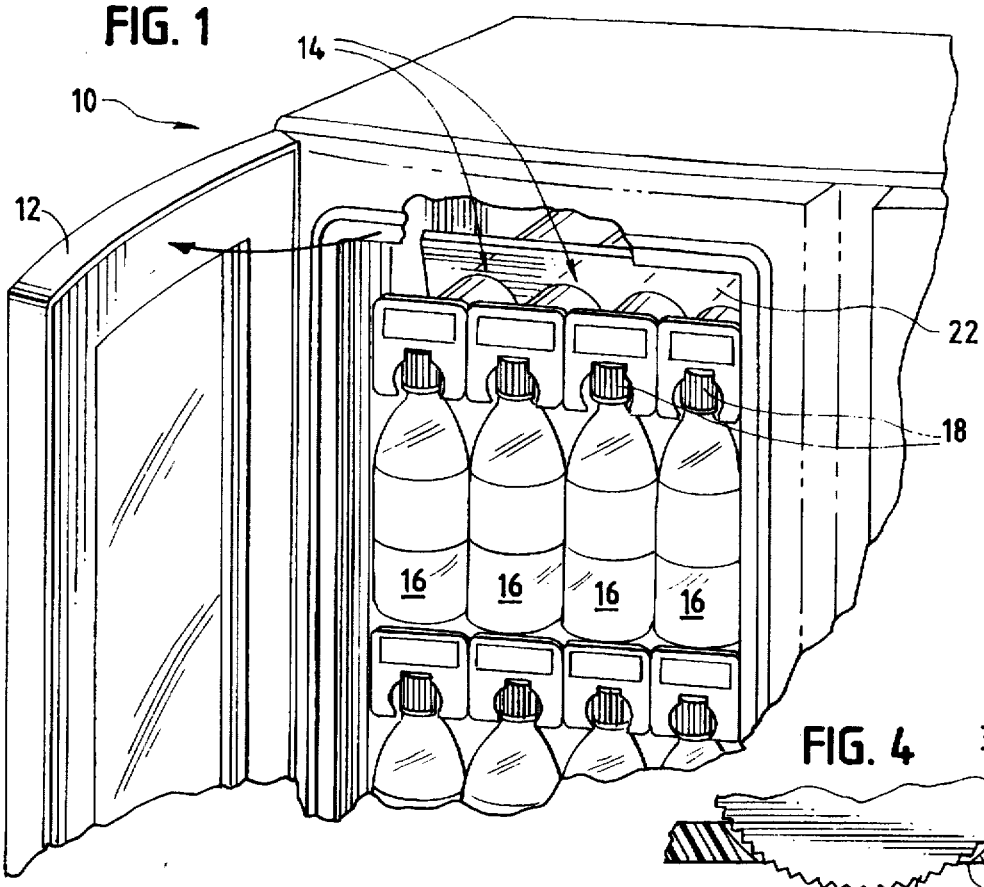
FIG. 1 is a partial perspective view showing a cooler with a plurality of track mechanisms disposed therein for retaining rows of bottles.
Figure 2:
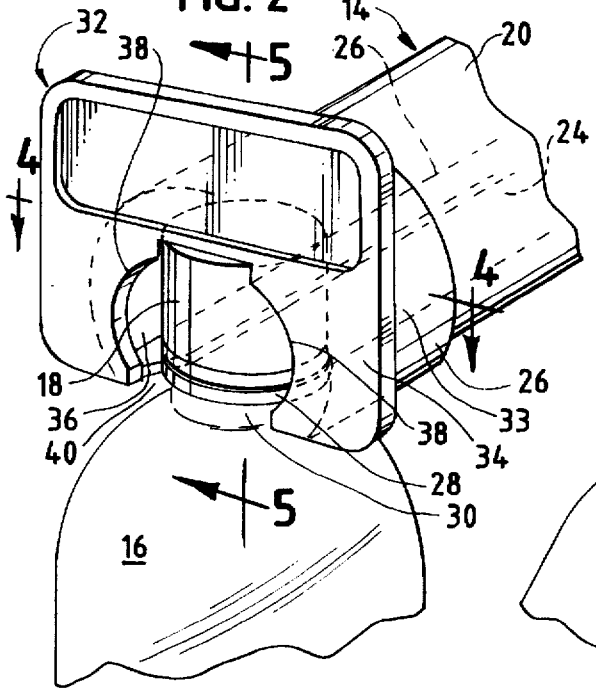
FIG. 2 is a partial perspective view showing a front end of one of the track assemblies supporting a bottle.

Referring to FIG. 1, there is shown a refrigerated cooler 10 having an open door 12 in which are located a plurality of track assemblies 14 supporting bottles 16 closed by a closure 18. As can be seen from FIG. 2, the assemblies 14 in each row each includes a tube 20 that is retained in position by a transversely extending support 22. Each tube 20 has a longitudinally extending bottom opening 24 defined by transversely spaced, longitudinally extending rails 26 on which the neck flanges 28 of the bottles 16 are supported. The spacing between the rails 26 is slightly greater than the outside diameter of the neck 30 of the bottle to permit free movement of the bottles down the rails. The rail spacing is less than the outer diameter of the bottle neck flange 28 to insure positive support of the bottle thereon as it moves down the track rails. The closure 18 is threaded onto the bottle finish above the bottle flange.

Figure 5:
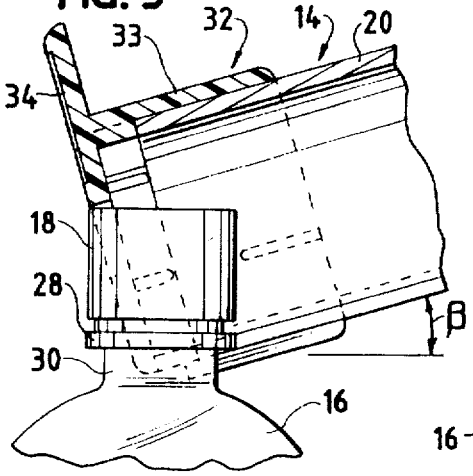
FIG. 5 is a view taken along line 5—5 of FIG. 2.
Figure 6:
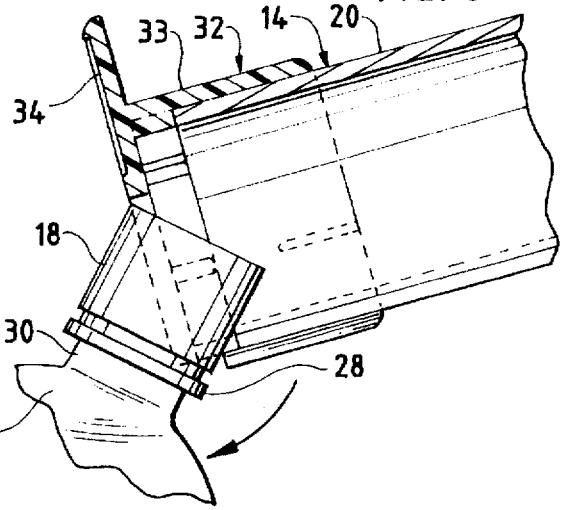
FIG. 6 is a view taken along line 6—6 of FIG. 3.
Figure 7:
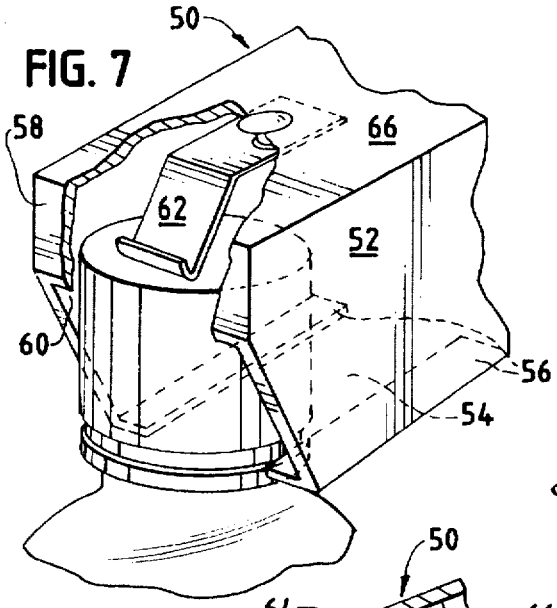
FIGS. 7, 8, 9, and 10 is another track assembly having rectangular tubular members and a front opening which is tilted upwardly from front to back.
Figure 8:
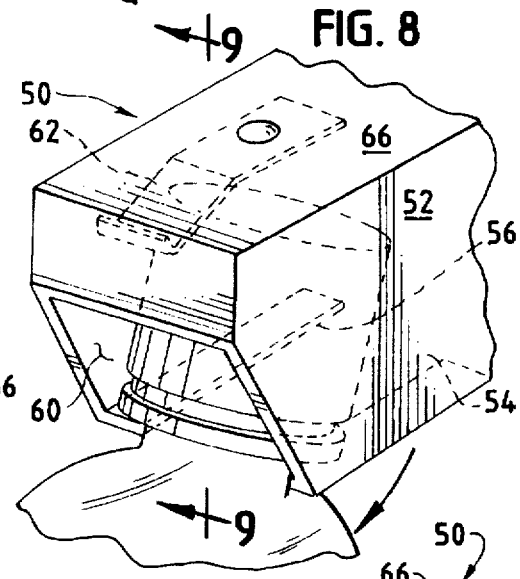

As shown in FIG. 5, the inclination of the track is shown by the angle β which can be on the order of 5° to 10° as desired, which insures that the bottles are continuously gravity fed in a downwardly inclined direction.

With this downwardly extending track construction, the bottles 16 will move forwardly on the rails 26 to the end thereof which is located adjacent the front door of the cooler. The forwardmost bottle in each row is prevented from exiting the rails 26 on which it is located by an end cap assembly 32 that is suitably secured to the tubular portion 20.

Figure 3:
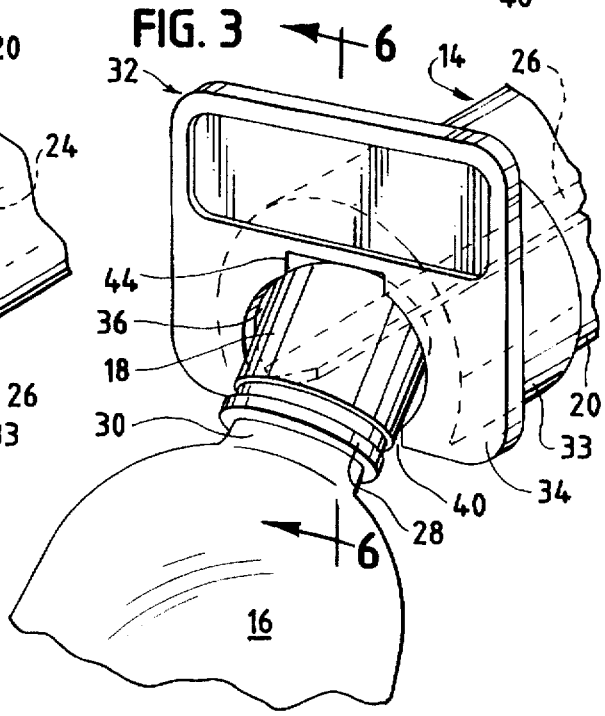
FIG. 3 is a view similar to FIG. 2 showing the bottle in a tilted position to facilitate removing of the bottle from the track assembly.

The end cap assembly 32 includes a tubular portion 33 that is suitably secured to the tube 20 and a plate member 34 that is designed to halt the downward movement of the front bottle in the row by serving as a stop for the closure 18. The plate 34 defines a generally circular opening 36 defined by circular segments 38 that have a diameter 40 that is larger than the diameter of closure 18. The opening 36 has an open bottom 40 that has a width slightly less than the closure outside diameter. It can be seen in FIG. 3 that when the bottle 16 is tilted toward the horizontal position, the closure 18 can be removed through the opening 36 defined by the segments 38 to permit the bottle 16 to be taken from the cooler 10.

Figure 4:
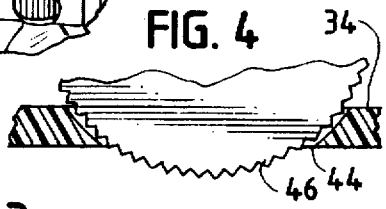
FIG. 4 is a view taken along line 4—4 of FIG. 2.

When the bottles move down the track rails 26, the tendency is for the front bottle to move out of alignment by virtue of the forward force due to the forces imposed by the other bottles in the row and the angularity of the rails relative to the horizontal. In order to maintain the bottle in proper alignment in the track, the opening 36 is provided with a recessed area 44 in its upper portion, as shown in FIG. 4. This recessed section 44 receives a small section 46 of the upper cylindrical portion of the closure 18 which maintains the closure 18 and associated bottle 16 in its proper position on the track rails.

By referring to FIGS. 2, 3, 5, and 6, it can be seen how the bottle and attached closure 18 is removed from the track assembly 14. Specifically, from the stationary end position shown in FIGS. 2 and 5, the bottle 16 is moved upwardly to the position shown in FIGS. 3 and 6 to where the closure 18 can be removed through the opening 36 and the bottle removed from the track and the cooler.

In a second embodiment shown in FIGS. 7–10, there is illustrated another track assembly arrangement 50 that is similar to the embodiment shown in FIGS. 1–6 in that it consists of a plurality of transversely spaced, longitudinally extending, generally rectangular tubular members 52 that are mounted in place within a cooler similar to that which is used to support the track assemblies disclosed in FIGS. 1–6. As described in detail hereinafter, the bottom of the tube 52 includes a longitudinally extending opening 54 defined by a pair of longitudinally extending rails 56. The tube 52 is tilted upwardly from front to back a slight amount on the order of 5° to 10° so that the bottles placed on the rails will tend to move downwardly by gravity when placed on the rails 56. The rails are spaced apart a distance slightly larger than the diameter of the bottle neck 30, but less than the diameter of the bottle neck flange 28. The neck flanges 28 of the bottles are slidably supported on the rails 56. There is a downwardly extending flange 58 located at the end of the tube 52 that prevents the end bottle from moving out of the track 50 and also maintains the bottle in its proper position on the rails 56, albeit by a slightly different construction than that shown in FIGS. 1–6.

Figure 10:
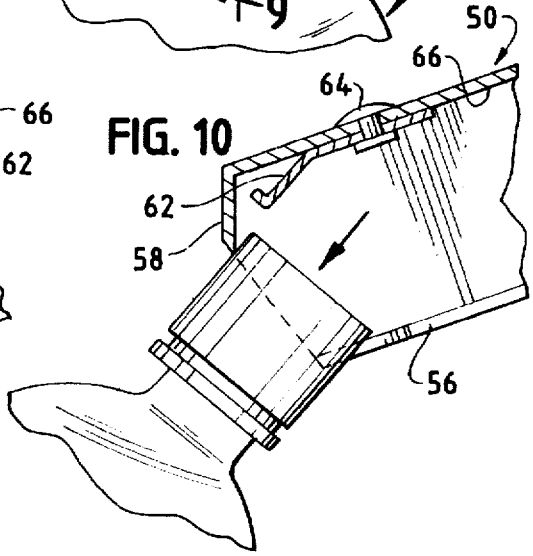

The front end of the tube 52 below the flange 58 defines an opening 60 that is smaller than the height of the closure and thus as aforementioned the closure and associated bottle will be prevented from exiting the track. However, the opening 60 below the flange 58 has a height and width that is larger than the diameter of the closure so that when the bottle is tilted toward the horizontal as shown in FIG. 10, the closure can be moved through the opening 60 and the bottle taken from the track.

Figure 9:
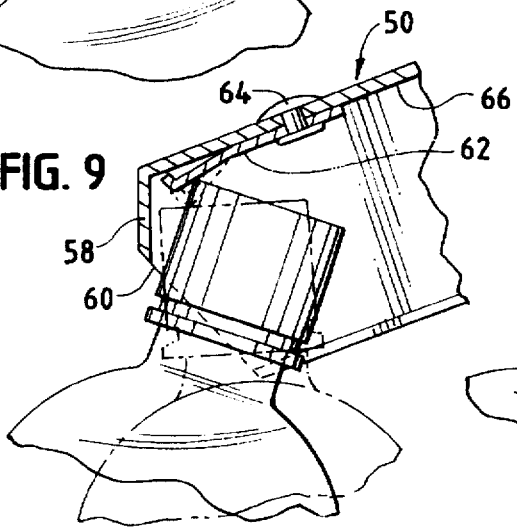

It is desirable that the bottle remain in the position as it moves down the track. However, if it tends to tilt as it reaches the front end of the track, the upper portion of the closure 18 engages a leaf spring 62 that is secured by rivet 64 to the upper wall 66 of the tubular track 52, which spring 62 prevents the tipping action from occurring. Of course, when the bottle is to be removed as shown in FIGS. 9 and 10, it is moved against the action of the spring 62 to the tilted position shown in FIG. 10.

It is intended to cover by the appended claims all such modifications as fall within the true spirit and scope of the invention.

What is claimed is:

1. A gravity feed merchandise dispensing system comprising a track support means, at least one longitudinally extending track assembly secured to said support means having front and rear ends, each track assembly including a pair of transversely spaced apart rails for supporting a row of similar bottles each having a closure secured thereto and an annular flange on the neck of the bottle with the underside of each bottle neck flange engaging and supported by the rails for movement relative to said rails, said track support means retaining the track in a downwardly inclined direction toward the front end of the track so the suspended bottles are gravity fed to the front end of the track as the lead bottle in a track is successively unloaded, the front end of each track assembly includes a stop means for said bottle closure and an opening having height and width dimensions whereby the closure will be prevented from exiting said opening when supported by said track assembly, but can be removed from said track through said opening when tilted with respect to said track assembly.

2. The gravity feed merchandise dispensing system in accordance with claim 1 in which the track assembly includes a tubular member that has a longitudinally extending open bottom portion that is defined by said rails.

3. The gravity feed merchandise dispensing system set forth in claim 2 in which the stop means comprises an end cap that is secured to said tubular member, which end cap defines said opening for the bottle closure to permit removal of the bottle from the track.

4. The gravity feed merchandise dispensing system set forth in claim 1 in which said opening is slightly wider than said closure, except for a section that is narrower than said closure and is positioned to receive a portion of the top of the closure, whereby the closure when located on the track will be captured by said section and prevented from tipping relative to said track assembly.

5. A gravity feed merchandise dispensing system as set forth in claim 4 in which the track assembly includes a tubular member that has an open bottom defined by said rails and the stop means comprises an end cap that is secured to said tubular member which end cap defines the opening to permit removal of the bottle from the track assembly when the bottle is moved to its generally horizontal position.

6. A gravity feed merchandise dispensing system as set forth in claim 1 in which the opening defined by said stop means is generally circular at its lower end and has a diameter slightly larger than that of the closure and an upper end that is smaller than the diameter of said closure and constructed and arranged to receive a front portion of said closure whereby the closure will normally be retained in position relative to said track assembly but can be removed therefrom when tipped relative thereto.

7. A gravity feed merchandise dispensing system in accordance with claim 1 in which said track support means includes a plurality of longitudinally spaced, transversely extending support frames to which a plurality of transversely spaced track assemblies are secured thereto.

8. A gravity feed merchandise dispensing system set forth in claim 1 in which the track assembly comprises a tubular member and the stop means at the front end consists of a flange that extends over the track for preventing the bottles from exiting the track and the opening located below said flange is slightly wider and higher than the diameter of said closure and has a height less than the height of said closure whereby the flange will prevent removal of the bottle from the track assembly but when the bottle is tilted toward the horizontal it can be removed through said opening.

9. A gravity feed merchandise dispensing system in accordance with claim 1 in which the track assembly includes a generally rectangular tube and resilient means attached to the inner portion of its upper wall adjacent the front end of said track assembly and positioned to engage the top of said closure of the forwardmost bottle in the row to retain the bottle in position on the rails in the event the bottle tends to tilt relative to said rails.

10. A gravity feed merchandise dispensing system in accordance with claim 9 in which the resilient means includes a longitudinally extending leaf spring which is secured to said upper wall that is in position to be engaged by said closure in the event the bottle tips relative to said track.

11. A track assembly including a pair of transversely spaced apart rails for supporting a row of similar bottles each having a closure secured thereto and an annular flange on the neck of the bottle with the underside of each bottle neck flange engaging and supported by the rails for movement relative to said rails, track support means for retaining the track in a downwardly inclined direction toward the front end of the track so the suspended bottles are gravity fed to the front end of the track as the lead bottle in a track is successively unloaded, the front end of each track assembly includes a stop means for said bottle closure and an opening having height and width dimensions whereby the closure will be prevented from exiting said opening when supported by said track assembly, but can be removed from said track through said opening when tilted with respect to said track assembly.

12. A track assembly in accordance with claim 11 which includes a tubular member that has a longitudinally extending open bottom portion that is defined by said rails.

13. A track assembly in accordance with claim 11 in which said opening is slightly wider than said closure, except for a section that is narrower than said closure and is positioned to receive a portion of the top of the closure, whereby the closure when located on the track will be captured by said section and prevented from tipping relative to said track assembly.

14. A track assembly in accordance with claim 11 comprising a tubular member and the stop means at the front end consists of a flange that extends over the track for preventing the bottles from exiting the track and the opening located below said flange is slightly wider and higher than the diameter of said closure and has a height less than the height of said closure whereby the flange will prevent removal of the bottle from the track assembly but when the bottle is tilted toward the horizontal it can be removed through said opening.

15. A track assembly in accordance with claim 11 which includes a generally rectangular tube and resilient means attached to the inner portion of its upper wall adjacent the front end of said track assembly and positioned to engage the top of said closure of the forwardmost bottle in the row to retain the bottle in position on the rails in the event the bottle tends to tilt relative to said rails.

* * * * *